US006355112B1

(12) United States Patent
Bartholmey et al.

(10) Patent No.: US 6,355,112 B1
(45) Date of Patent: Mar. 12, 2002

(54) SYSTEMS AND METHODS FOR EXTRACTING LIQUID FROM FLOOR COVERINGS

(75) Inventors: Brett Bartholmey, Bellingham; Kevin A. Wolfe, Mt. Vernon, both of WA (US)

(73) Assignee: Dri-Eaz Products, Inc., Burlington, WA (US)

( * ) Notice: Subject to any disclaimer, the term of this patent is extended or adjusted under 35 U.S.C. 154(b) by 0 days.

(21) Appl. No.: 09/632,427

(22) Filed: Aug. 4, 2000

(51) Int. Cl.[7] ..... G08B 5/04

(52) U.S. Cl. ..... 134/21; 134/6; 134/32; 134/42; 15/322; 15/340.2

(58) Field of Search ..... 15/322, 340.2; 134/6, 21, 32, 42

(56) References Cited

U.S. PATENT DOCUMENTS

| | | | | |
|---|---|---|---|---|
| 4,264,999 A | | 5/1981 | Monson | |
| 4,333,204 A | | 6/1982 | Monson | |
| 4,339,840 A | | 7/1982 | Monson | |
| 4,441,229 A | | 4/1984 | Monson | |
| 4,692,959 A | | 9/1987 | Monson | |
| 5,147,467 A | * | 9/1992 | Virtue | 134/18 |
| 5,357,650 A | | 10/1994 | Finley | |
| 5,463,791 A | | 11/1995 | Roden | |
| 5,561,883 A | * | 10/1996 | Landry et al. | 15/302 |
| 5,647,090 A | * | 7/1997 | Yang | 15/322 |
| 6,152,151 A | | 11/2000 | Bolden et al. | |

* cited by examiner

*Primary Examiner*—Sharidan Carrillo
(74) *Attorney, Agent, or Firm*—Michael R. Schacht; Schacht Law Office, Inc.

(57) ABSTRACT

An extractor tool for extracting invasive fluid from a floor covering defining a floor surface. The extractor tool comprises a frame assembly, an extraction head, and a drive roller. The frame assembly defines a support surface. The extraction head is mounted to the frame assembly and defines an extraction opening that engages the floor surface. The drive roller assembly is mounted to the frame assembly and also engages the floor surface. A user stands on the support surface between the extraction head and the drive roller assembly such that the user's weight is transferred to the floor surface through the extraction head and the driver roller assembly. The user operates the driver roller assembly to propel the extractor tool along the floor surface.

8 Claims, 10 Drawing Sheets

20
24
42
26
260
22
32
D
30
40
28
34

24
42
46
20
22
26
A
44
30
28
34
40

6
138
136
182
26
56
52
22
54b
62
20
54a
28
34
58
132
122
30
124
134
142
146
150
68
144
186
180
56a
60
54c
64
140
6

SYSTEMS AND METHODS FOR EXTRACTING LIQUID FROM FLOOR COVERINGS

TECHNICAL FIELD

The present invention relates to liquid extraction tools and, more specifically, to tools for extracting water and other liquids from floor coverings such as carpets.

BACKGROUND OF THE INVENTION

Water and other liquids are often introduced into buildings by floods, sprinkler systems, plumbing and sewer leaks, and the like. In the following discussion, the term "invasive liquid" will refer to any liquid that inadvertently or undesirably enters or remains in a building.

In many cases, if the invasive liquid is not immediately removed, permanent damage to the building or its contents may occur. For example, a carpet that is soaked with water may create an environment that nurtures the growth of molds and mildew. Such molds and mildew can, at a minimum, create undesirable odors and in some situations can pose health risks for the building's occupants. Conventionally, if a floor covering, wall covering, or building structure became damaged because of inadequate drying, the damaged item was removed and replaced, often at considerable expense.

To avoid the expense of repairing water damaged buildings and their contents, a number of systems and methods have been developed for use by restorative drying professionals to remove invasive liquids from buildings. Restorative drying systems can be as simple as a blower that forces air over a surface to be dried or as complex as a dehumidifier that extracts water from air to enhance conditions conducive to drying. Often, a number of systems are used together in one complete system that is tailored to a specific situation.

The present invention relates to the specific problem of removing invasive liquids from floor coverings such as carpets, rugs, hardwood, linoleum, vinyl, and the like. Often, the floor covering can trap the invasive liquid in a manner that prevents or slows down the drying of the overall floor structure using conventional restorative drying systems and methods.

The need thus exists for improved systems and methods for extracting water and other invasive liquids from floor coverings such as carpets.

PRIOR ART

The Applicant is aware of a number of systems and methods for removing invasive liquids from floor coverings. A number of such systems and methods have been developed specifically for use by restorative drying professionals.

A class of related water extraction includes industrial and residential carpet cleaning devices. Carpet cleaning devices spray water and detergent onto a carpet adjacent to a suction head. The suction head is drawn or pushed over the sprayed section of carpet to remove the water, detergent, and dirt or debris in the carpet. The suction head is normally a hollow member that defines a plenum adjacent to an elongate slot. The plenum is connected to a vacuum device that causes air and entrained invasive liquid to be drawn through the slot, the plenum, and a reservoir of the vacuum device. Carpet cleaning devices thus differ from devices used by restorative drying professionals in that the carpet cleaning devices first introduce liquids into the floor covering before removing this liquid.

A similar structure is used by a class of products commonly referred to as wet/dry vacs. A conventional wet/dry vac comprises a suction head and a vacuum device defining a reservoir for containing liquids entrained in the air drawn through the suction head. Except for the liquid reservoir and the materials used in bringing the air/liquid to the reservoir, the basic design of a wet/dry vac is similar to that of a canister-style vacuum cleaner.

SUMMARY OF THE INVENTION

The present invention may be embodied as an extractor tool for extracting invasive fluid from a floor covering defining a floor surface. The extractor tool comprises a frame assembly, an extraction head, and a drive roller. The frame assembly defines a support surface. The extraction head is mounted to the frame assembly and defines an extraction opening that engages the floor surface. The drive roller assembly is mounted to the frame assembly and also engages the floor surface. A user stands on the support surface between the extraction head and the drive roller assembly such that the user's weight is transferred to the floor surface through the extraction head and the driver roller assembly. The user operates the driver roller assembly to propel the extractor tool along the floor surface.

The present invention may also be embodied as a method of extracting invasive fluid from a floor covering defining a floor surface. Such a method comprises the step of providing a frame assembly defining a support surface. An extraction head is mounted onto to the frame assembly, the extraction head defining an extraction opening that engages the floor surface. A drive roller assembly is mounted to the frame assembly, and the drive roller assembly engages the floor surface. A user stands on the support surface between the extraction head and the drive roller assembly such that the weight on the support surface is transferred to the floor surface through the extraction head and the driver roller assembly. The drive roller assembly is then operated to propel the extractor tool along the floor surface.

Other features and aspects of the present invention will become apparent from the following detailed description of the invention.

DETAILED DESCRIPTION OF THE INVENTION

Figure 1:
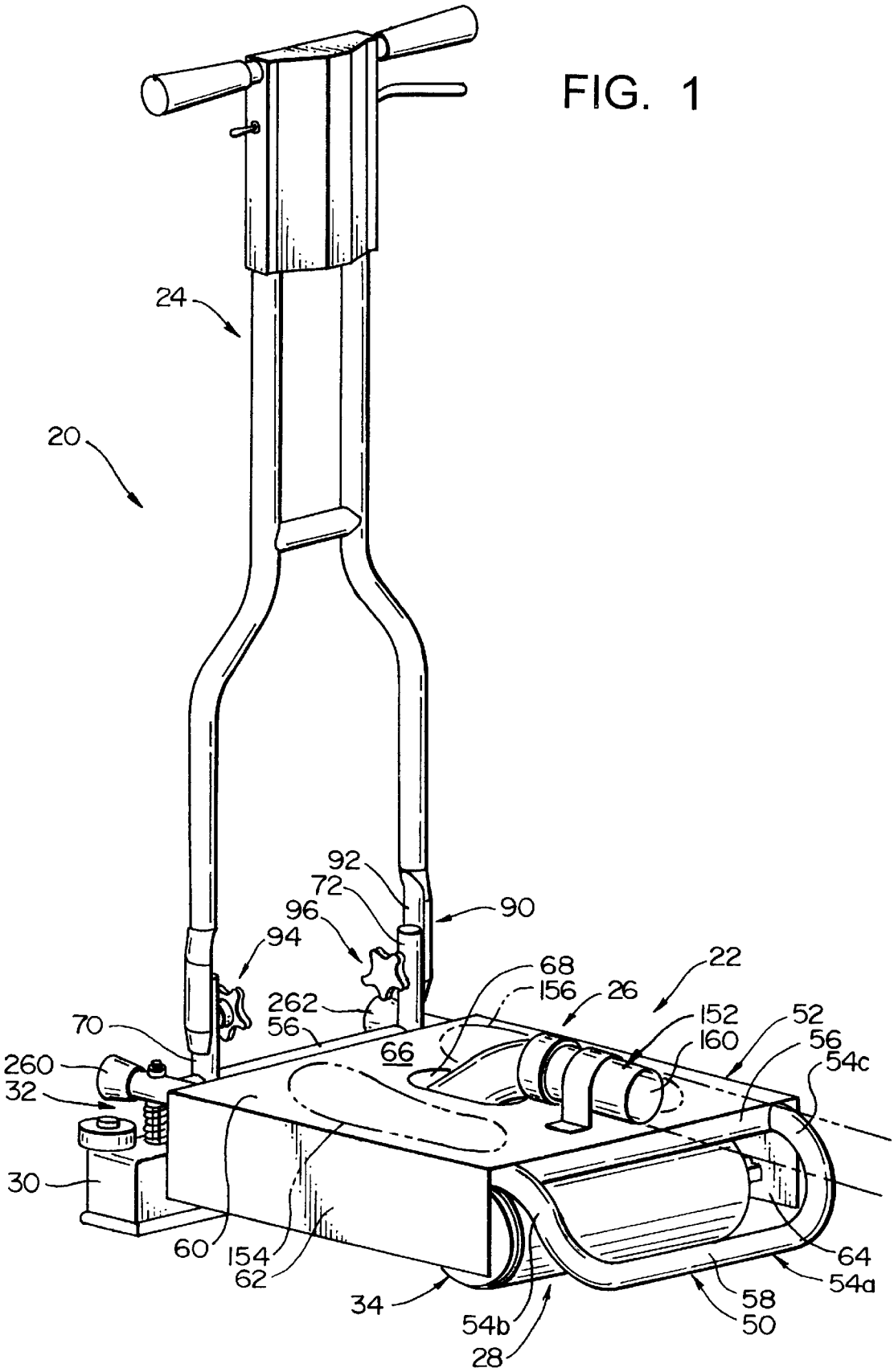
FIG. 1 is a perspective view depicting an exemplary extraction tool constructed in accordance with, and embodying, the present invention.

Referring initially to FIG. 1 of the drawing, depicted at 20 therein is an exemplar extraction tool constructed in accordance with, and embodying, the principles of the present invention.

The extraction tool 20 comprises a base assembly 22, a handle assembly 24, an extraction system 26, and a drive system 28. The exemplary extraction system 26 comprises an extraction head 30. The base assembly 22 comprises a suspension system 32 for supporting the extraction head 30. The drive roller system 28 comprises a drive roller assembly 34.

During use, the handle assembly 24 extends upwards from the base portion 22. The exemplary extraction head 30 is mounted adjacent to a front edge of the base portion 22 by the suspension system 26. The drive roller assembly 34 is mounted adjacent to a rear edge of the base portion 22.

Figure 2:
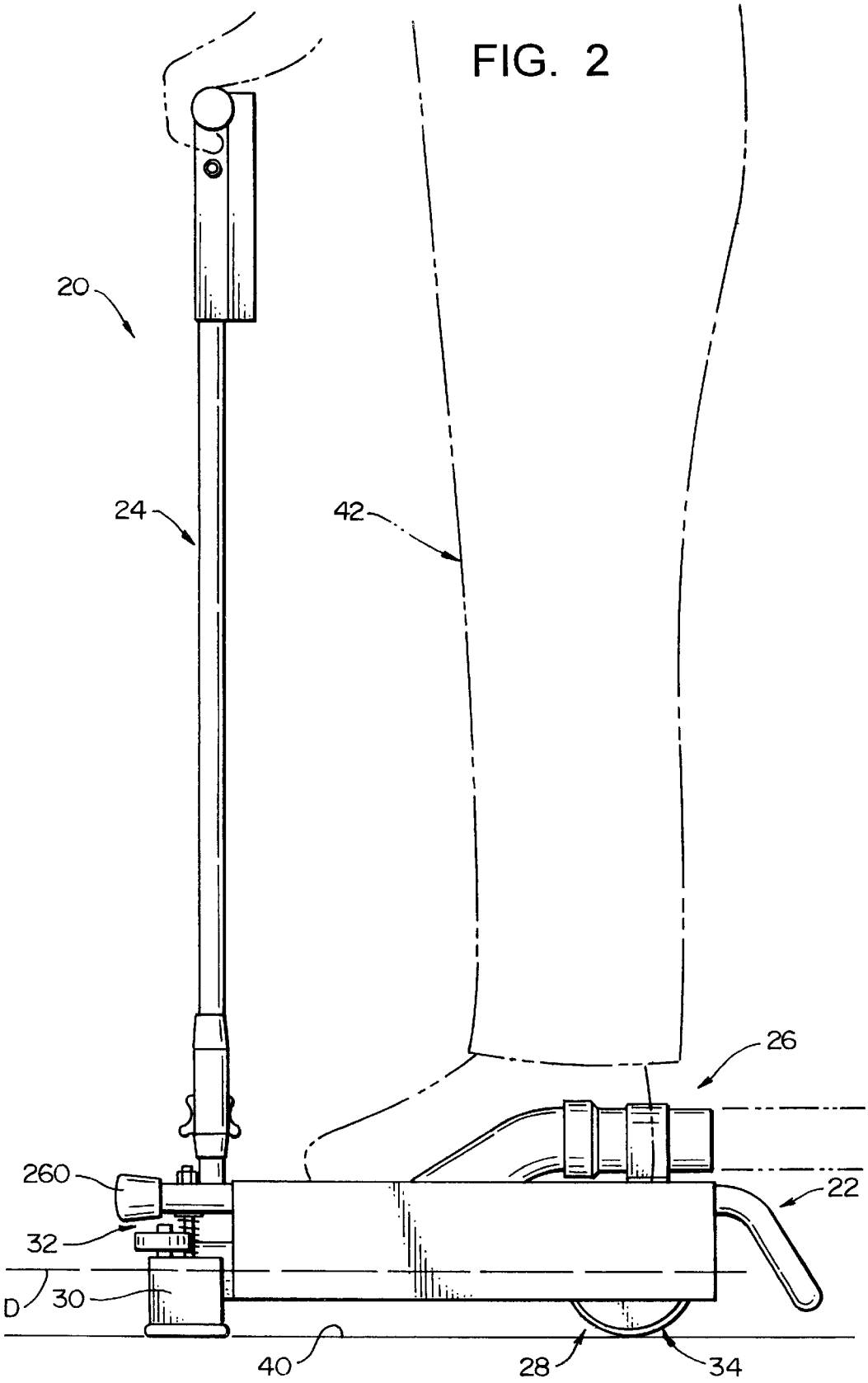
FIG. 2 is a side elevation view of the extraction tool of FIG. 1 showing the extraction tool in a use configuration.
Figure 2A:
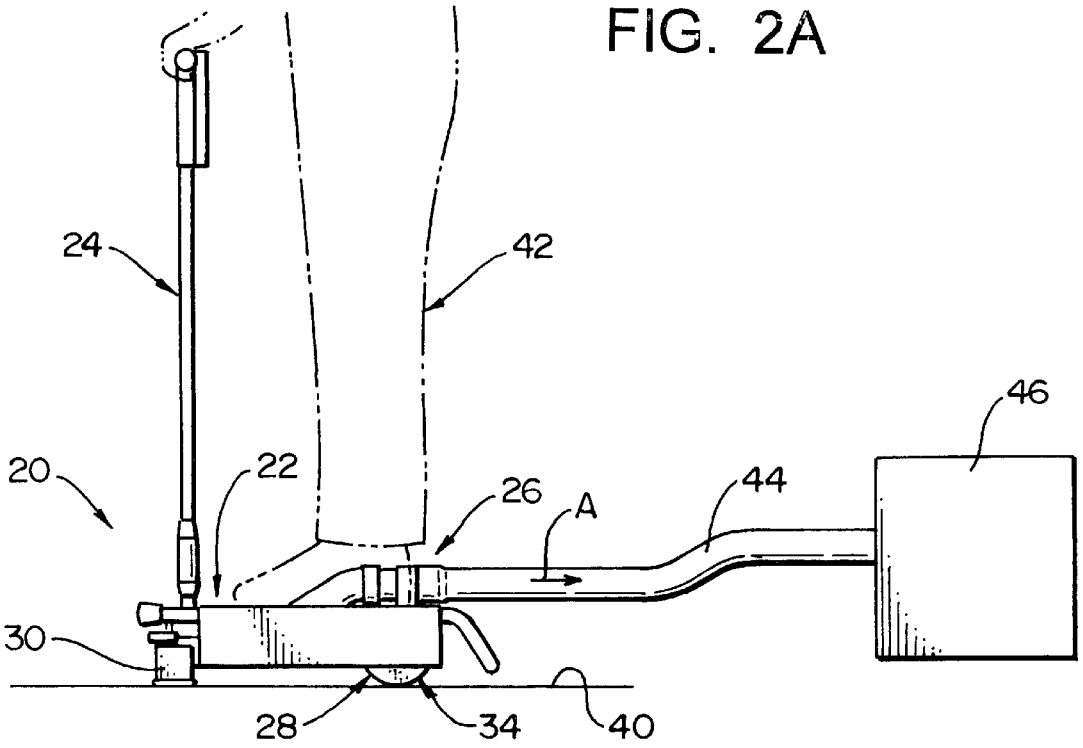
FIG. 2A is a somewhat schematic view depicting an exemplary extraction system incorporating the extraction tool of FIG. 1.

As perhaps best shown in FIGS. 2 and 2A, the extraction head 30 and drive roller assembly 34 support the base assembly 22 on a floor surface 40. A user 42 stands on the base assembly 22 while gripping the handle assembly 24. The extraction system 26 is connected by a hose 44 to a vacuum extraction machine 46.

The vacuum extraction machine 46, which is commonly called an extractor, extraction machine, or cleaning system, is conventional and will not be described in detail herein beyond what is necessary for a complete understanding of the present invention. Conventionally, the vacuum extraction machine 46 is portable or truck mounted.

The vacuum extraction machine 46 establishes a vacuum that draws air through the extraction head 30 and the hose 44 in the direction shown by arrow A in FIG. 2A. The air drawn through the extraction head 30 entrains liquids, including invasive liquids, in any floor covering that forms the floor surface 40.

A portion of the weight of the user 42 is transferred to the floor surface 40 through a first load bearing path extending through the base assembly 22, the suspension system 32, and the extraction head 30. The remaining portion of the user's weight is transferred to the floor surface through a second load bearing path extending through the base assembly 22 and the drive roller assembly 34. The proportion of the user's weight carried by the first and second load bearing paths can thus be adjusted simply by the user 42 moving slightly towards or away from the handle assembly 24.

The drive roller assembly 34 rolls along the surface 40, while the extraction head 30 slides rather than rolls along the floor surface 40; accordingly, moving the users weight towards the extraction head 30 will increase friction between the extraction tool 20 and the floor surface 40 and thus slow the speed of the tool 20. On the other hand, the user 42 can increase the speed of the extraction tool 20 by shifting weight towards the drive roller assembly 34.

Figure 3:
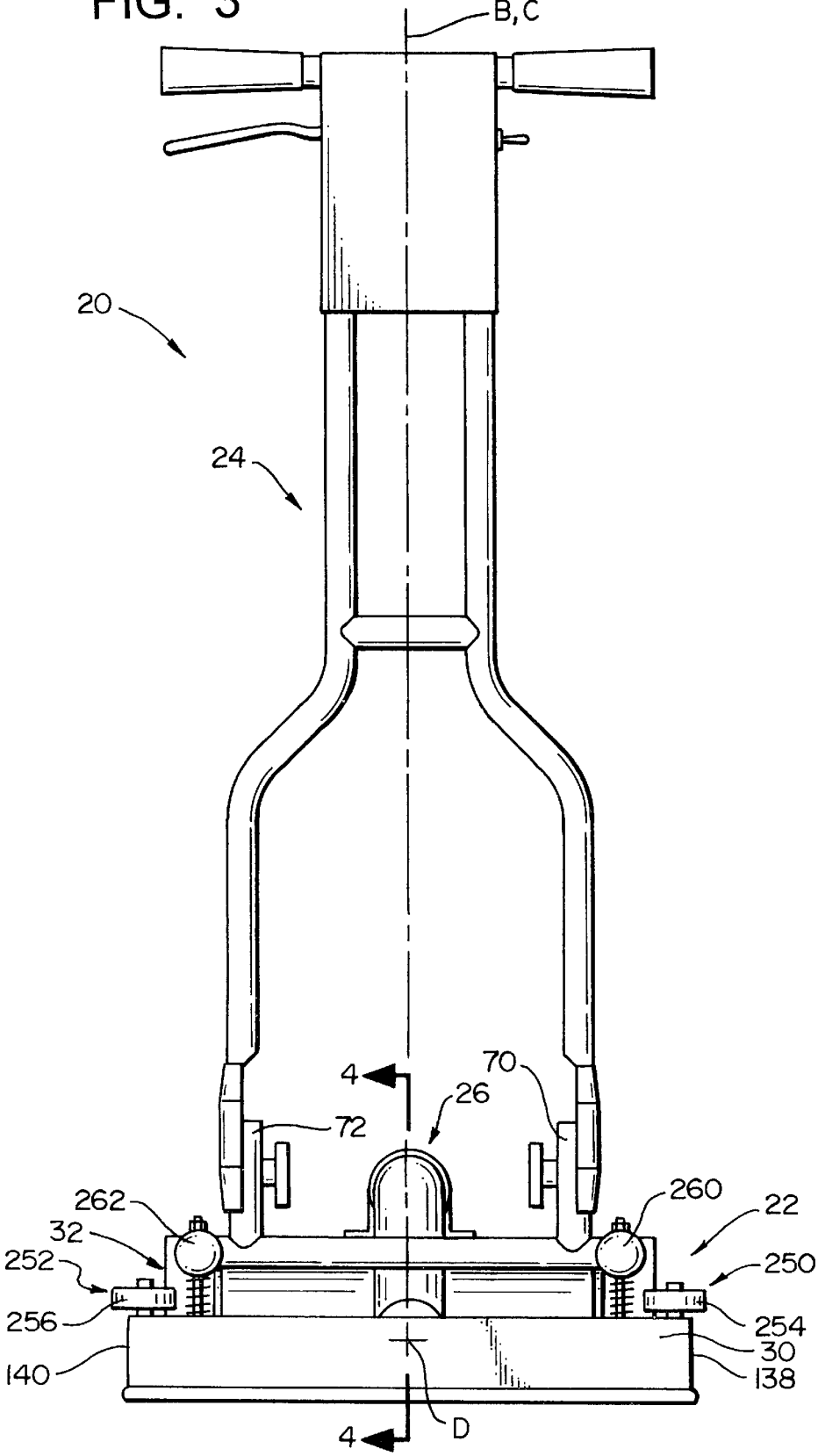
FIG. 3 is a front elevation view of the extraction tool of FIG. 1.
Figure 7:
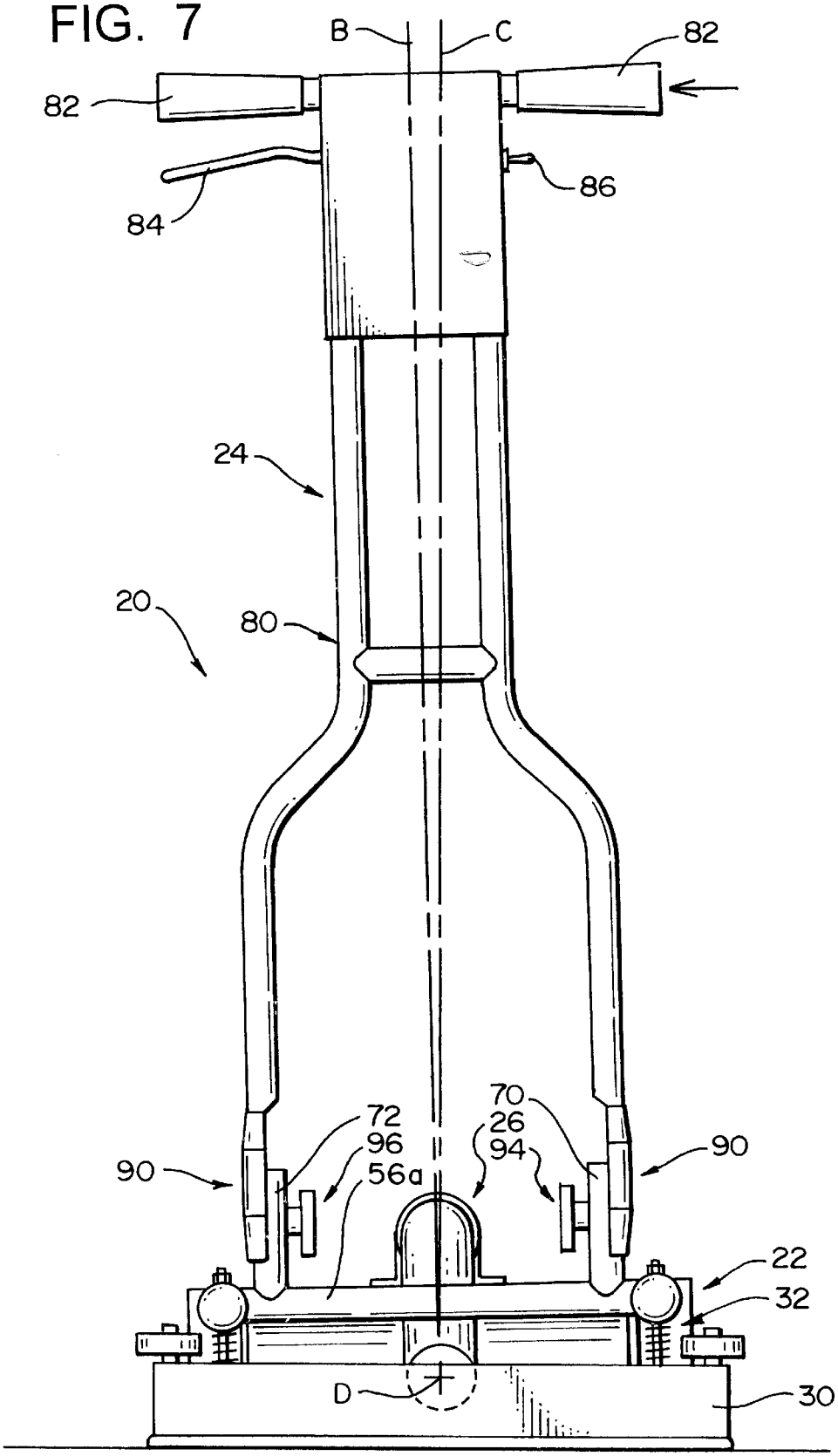
FIG. 7 is a front elevation view of the extraction tool of FIG. 1 depicting the extraction tool in a right turn configuration.

In addition, referring now to FIGS. 3 and 7, the extraction tool 20 defines an upright axis B that extends from the base assembly 22 along the handle assembly 24. The upright axis B may be aligned with a true vertical axis C extending through a centerline D of the base assembly 22 (FIG. 3). However, the suspension system 32 allows the user to shift his or her weight form one side to the other of the centerline D such that the upright axis B is not aligned with the true vertical axis C (FIG. 7). Shifting the users weight from one side to the other of the centerline D causes the extraction tool 20 turn.

Accordingly, the user 42 may steer the extraction tool 20 during use without the provision of a complicated or expensive turning mechanism.

The details of construction and operation of the extraction tool 20 will now be described in further detail.

Referring initially to the base assembly 20, the base assembly 20 comprises a base frame 50 and a base housing 52. The base frame comprises a peripheral frame member 54 and a plurality of cross members 56. The exemplary peripheral frame member 54 is a hollow tube formed in a generally U-shaped configuration having a closed end portion 54*a* and first and second side portions 54*b* and 54*c*. The closed end portion 54*a* of the frame member 54 forms a handle 58 for the extraction tool 20. As perhaps best shown in FIGS. 4 and 5, the cross members 56 are rigidly connected between the side portions 54*b* and 54*c* of the frame member 54.

The exemplary base housing 52 comprises a sheet of rigid metal that is bent to form an upper portion 60 and first and second side portions 62 and 64. The upper portion 60 is supported by three of the cross members 56 and defines a support surface 66 on which the user 42 stands. An pipe opening 68 is formed in the housing upper portion 60; the purpose of the pipe opening 68 will become apparent from the following discussion.

Extending upwardly from the forward-most cross member 56*a* are first and second handle struts 70 and 72. The handle struts 70 and 72 form a rigid connection point for the handle assembly 24, as will be described in further detail below.

A primary purpose of the base assembly 20 is to form a rigid structure that can transfer the weight of the user 42 to the extraction head 30 and the drive wheel assembly 34 along the first and second load paths described above. The base assembly 20 must also bear the loads applied to the handle assembly 24 during use. The exemplary base assembly 22 performs these functions and can be inexpensively and reliably manufactured. The details of the base assembly 22 do not, however, form a part of the present invention, and other base assemblies may be substituted therefor. For example, all or part of the base assembly 22 may be made entirely of molded plastic or a combination of a metal frame and a plastic housing. The choice of design and materials can be made by one of ordinary skill in the art based on appropriate cost factors.

Referring now to FIG. 7, that figure shows that the exemplary handle assembly 24 comprises a handle frame 80, a pair of grip members 82, an operation switch mechanism 84, and a direction switch mechanism 86.

The handle frame 80 is a rigid structure that supports the grip members 82 a desired distance above the handle struts 70 and 72. The grip members 82 are conveniently located for balance and support by the user 42 and are symmetrically spaced on either side of the upright axis B. The handle frame 80 and grip members 82 form a rigid structure capable of transmitting balancing and steering forces applied to the grip members 82 to the handle struts 70 and 72; any structure capable of performing this function may be substituted for the frame 80 and grip members 82.

The operation switch mechanism 84 is connected to allow the user 42 to apply power to the drive system 28 to propel the extraction tool 20. The direction switch mechanism 86 is arranged to control the direction, either forward or reverse, in which the drive system 28 propels the tool 20.

The operation switch mechanism 84 is in the form of a conventional "dead man's switch" that must be held up against one of the grip members 82 to propel the tool 20. The tool 20 is stopped simply by releasing the switch mechanism 84. The direction switch mechanism 86 is a conventional toggle switch that, when toggled forward, causes forward movement, and, when toggled towards the rear, causes reverse movement.

The switch mechanisms 84 and 86 are or may be conventional, and the integration of these with the drive system 28 will be clear to one of ordinary skill in the art based on the following description.

The handle frame 80 may be rigidly connected to the handle struts 70 and 72. In the exemplary extraction tool 20, however, the handle frame comprises connection portions 90 having bearing surfaces 92 (FIGS. 1 and 4) adapted to engage the outer surfaces of the struts 70 and 72. The exemplary tool 20 thus further comprises first and second handle lock screw assemblies 94 and 96 that may be operated in locked or unlocked positions.

Figure 8:
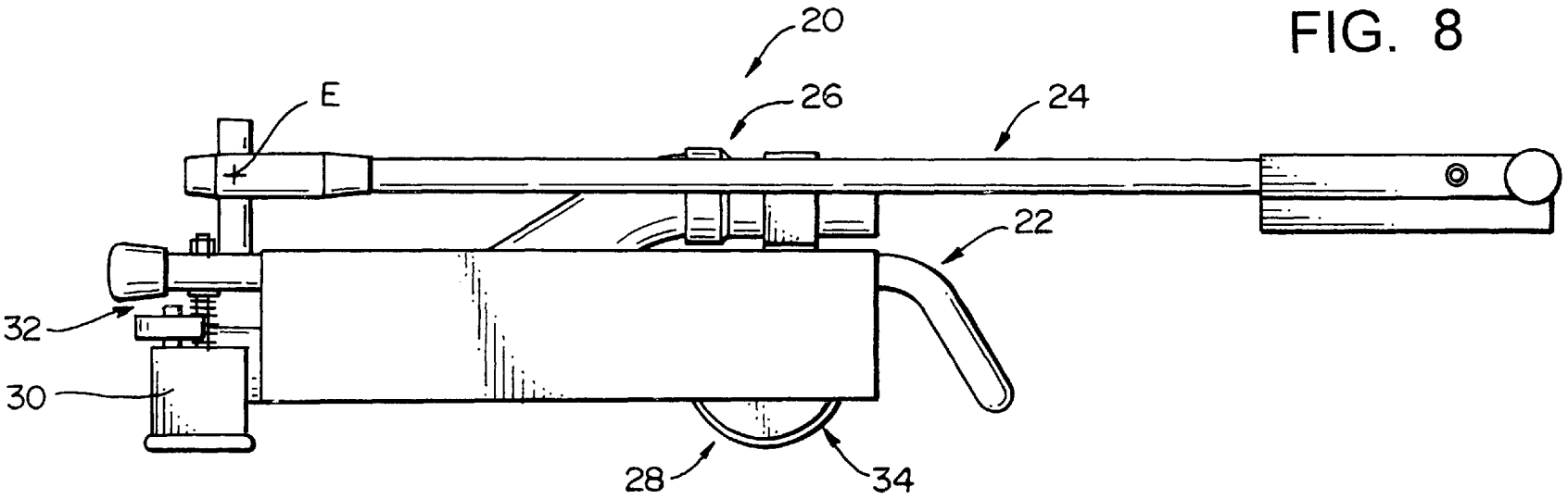
FIG. 8 is a side elevation view of the extraction tool of FIG. 1 showing the extraction tool in a storage/transportation configuration.

In the locked position, the screw assemblies 94 and 96 snugly old or clamp the connection portions 90 against the struts 70 and 72. With the screw assemblies 94 and 96 in their unlocked positions, the connection portions 90 move away from the struts 70 and 72 sufficiently to allow the handle assembly 24 to move from a use position (FIGS. 1, 2, 2A, 3, 4, and 7) and a storage/transportation position (FIG. 8). The screw assemblies 94 and 96 may be placed in the locked position to hold the handle assembly 24 in either the use or storage/transportation positions as required. The handle portion 58 of the base frame 50 is arranged to allow the extraction tool 20 to be comfortably carried when the handle assembly 24 is locked into the storage/transportation position.

Figure 4:
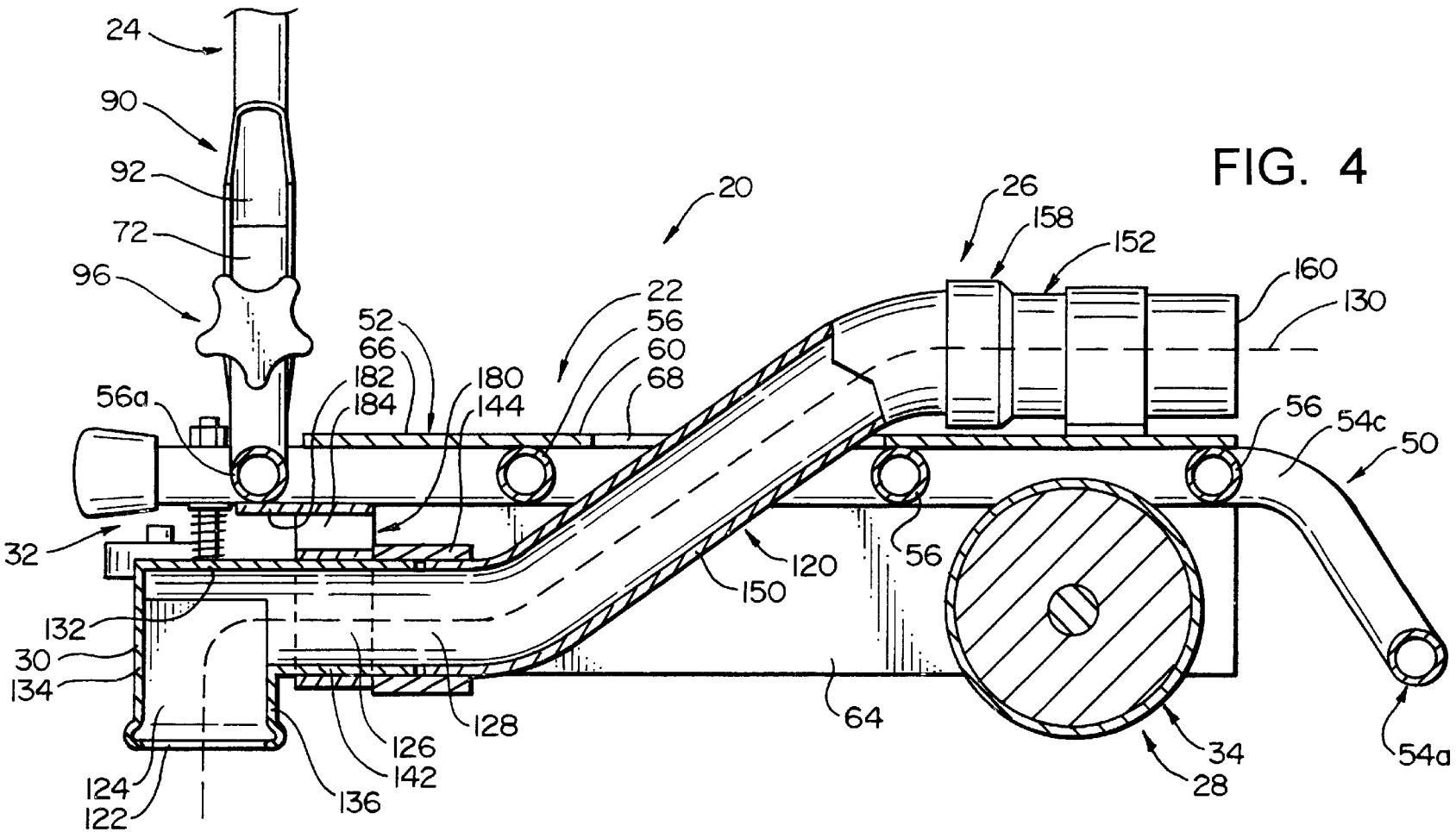
FIG. 4 is a section view of the extraction tool of FIG. 1 taken along lines 4—4 in FIG. 3.

As perhaps best shown in FIG. 4, the extraction system 26 comprises the extraction head 30 described above and an extraction pipe assembly 120. The extraction head 30 defines an extraction opening 122 that faces the surface 40 during use. The extraction head 30 further defines an extraction chamber 124, a coupler chamber 126, and a coupler opening 128. The extraction chamber 124 is in fluid communication with the extraction opening 122 at its bottom side and with the coupler chamber 126 at its rear side. The coupler chamber 126 is in fluid communication with the extraction pipe assembly 120 through the coupler opening 128.

When the vacuum extraction machine 46 is operated, air and entrained invasive liquid is drawn from the floor covering along an extraction passageway 130 at least partly defined by the extraction opening 122, extraction chamber 124, coupler chamber 126, coupler opening 128, and extraction pipe assembly 120. In particular, air and entrained invasive liquid enters the extraction chamber 124 through the extraction opening 122, passes into and through the coupler chamber 126, exits the extraction head 30 through the coupler opening 128, and enters the extraction pipe assembly 120.

Figure 5:
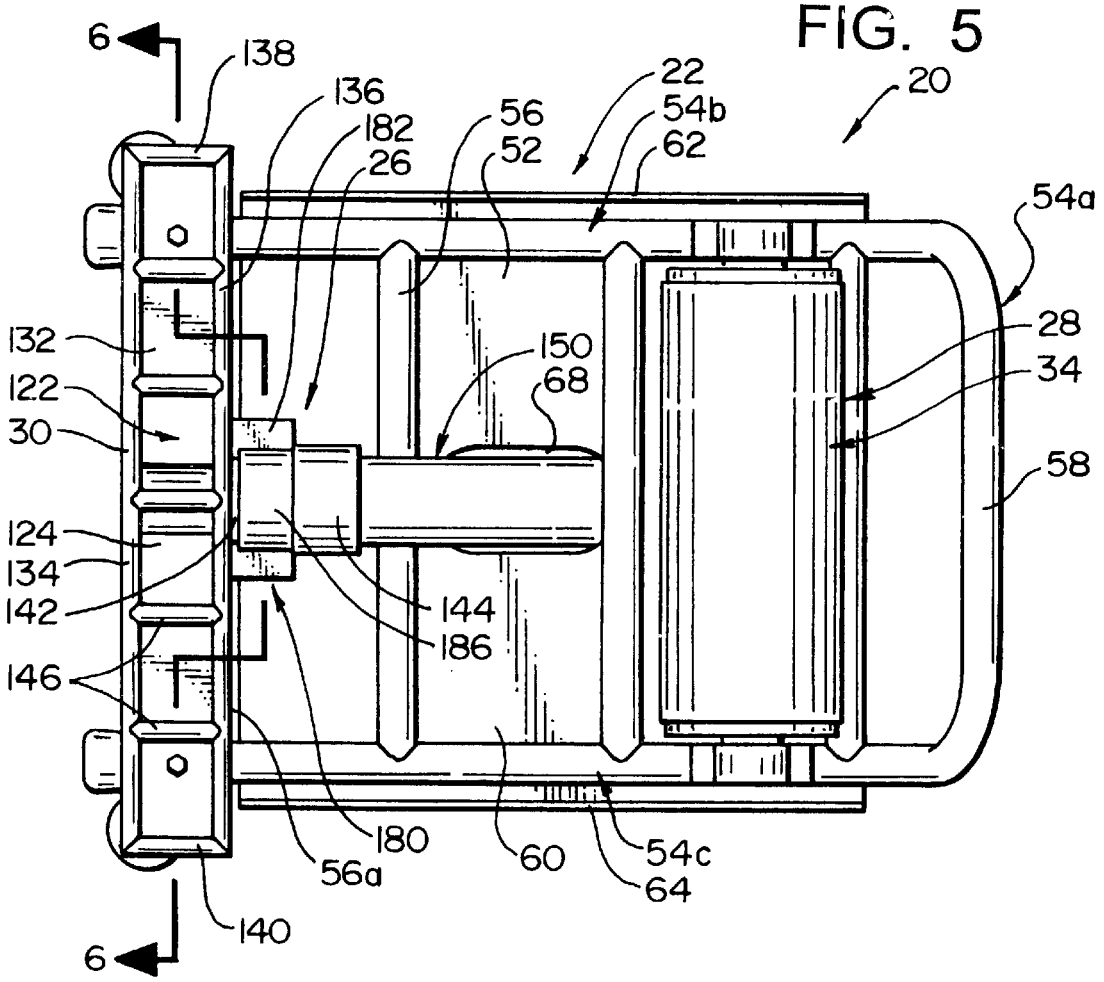
FIG. 5 is a bottom plan view of the extraction tool of FIG. 1.

As perhaps best shown in FIG. 5, the exemplary extraction head 30 has an upper wall 132, front wall 134, rear wall 136, left side wall 138, and right side wall 140. The absence of a bottom wall forms the extraction opening 122. In addition, the extraction head 30 comprises a coupler housing 142 formed on the rear wall 136. The coupler housing 142 defines a coupler fitting 144 and the coupler opening 128. To enhance the structural strength of the head 30, ribs 146 extend between the front wall 134 and the rear wall 136.

Figure 6:
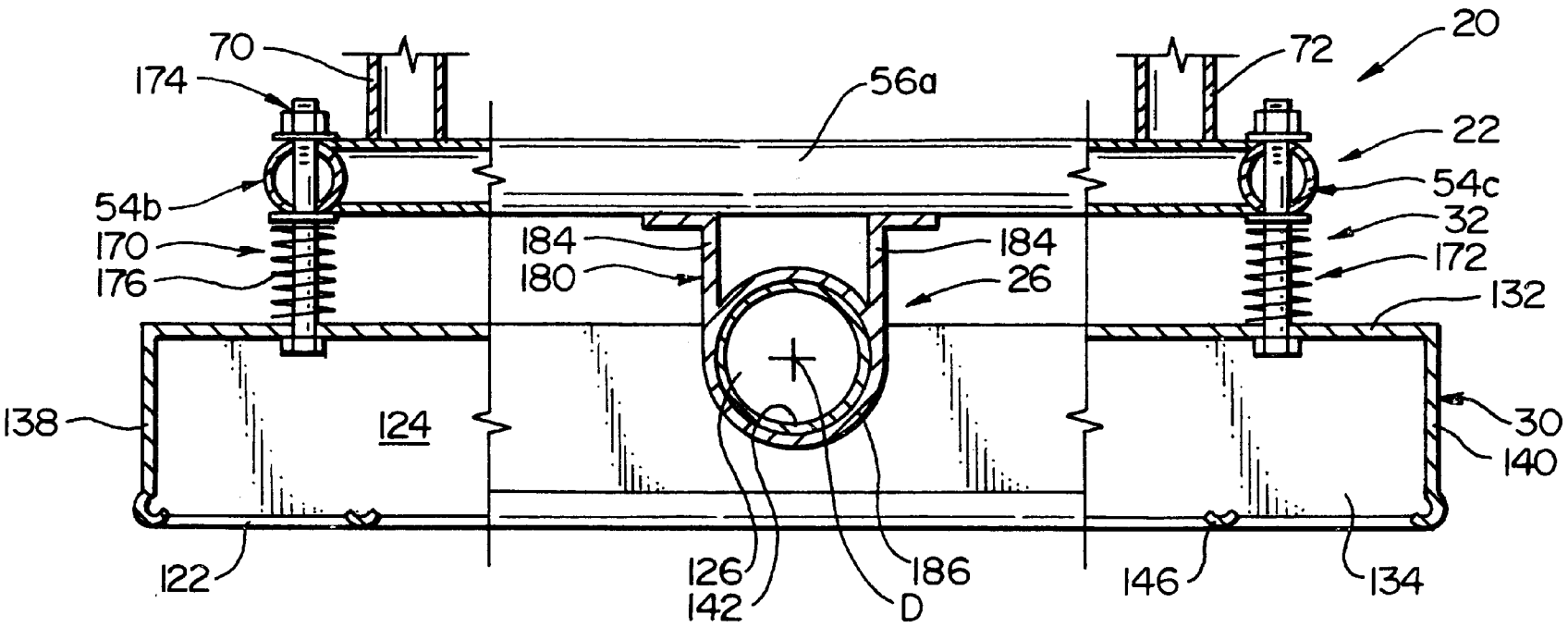
FIG. 6 is a section view of the extraction tool of FIG. 1 taken along lines 6—6 in FIG. 5.

Referring now to FIG. 6, that figure shows that the exemplary extraction head 30 is symmetrically arranged about the centerline D. In particular, the coupler fitting 144 and coupler opening 128 defined thereby are cylindrical, with the centerline D being aligned with the center axis of the coupler opening 128. Although the extraction head 30 need not be symmetrical when implementing the present invention in its broadest form, a substantially symmetrical extraction head 30 is desirable for reasons that will become apparent from the following discussion.

The exemplary extraction head 30 is molded out of plastic, which reduces friction and wear on the floor covering and can be manufactured relatively cheaply and replaced when worn. Although the exemplary extraction head 30 is particularly suited for the described purpose, other materials and shapes may be used to accomplish this purpose.

Referring back to FIG. 4, it can be seen that the extraction pipe assembly 120 comprises a flexible pipe 150 and an upper coupler 152. The upper coupler 152 is securely attached to the base assembly 22 at a location spaced between and slightly behind foot locations 154 and 156 on the support surface 66. The flexible pipe 150 is securely connected at one end to the coupler fitting 144 and at the other end to a fitting portion 158 of the upper coupler 152. The flexible pipe 150 passes through the pipe opening 68 in the base housing 52. The upper coupler 152 defines an outlet opening 160 that is in fluid communication with the coupler opening 128 of the extraction head 130 through the flexible pipe 150. Accordingly, the extraction passageway 130 is further defined by the outlet opening 160.

The upper coupler 152 is securely connected to the hose 44 described above. The extraction passageway 130 is thus further defined by the hose 44. The extraction passageway 130 forms a substantially airtight path from the extraction opening 122 to the vacuum extraction machine 46 such that the extraction machine 46 draws air and entrained invasive liquid from the portion of the floor covering covered by the extraction opening 122.

As best shown in FIG. 6, the exemplary suspension system 32 comprises first and second suspension assemblies 170 and 172 each comprising a bolt assembly 174 and a resilient member 176. The bolt assemblies 174 engage the frame member 54 of the base assembly 22 and the upper wall 132 of the extraction head 30 to connect the extraction head 30 to the base assembly 22. The exemplary bolt assemblies 174 do not rigidly connect the extraction head 30 to the base assembly 22, but instead allow movement of the head 30 relative to the base assembly 22 within a limited range.

The resilient members 176 are arranged between the extraction head 30 and the base assembly 22 to oppose movement of the head 30 towards the base assembly 22 within the range of movement allowed by the bolt assemblies 174. The exemplary resilient members 176 are illustrated as springs under compression, but any member that deforms to oppose movement of the base assembly 22 relative to the extraction head 30 may be used. For example, the resilient members 176 may be formed by rubber bushings.

The exemplary first and second suspension assemblies 170 and 172 are arranged at equal distances from the centerline D. The suspension system 32 thus allows a slight pivoting movement of the extraction head 30 relative to the base assembly 22 about the centerline D. This pivoting action allows the upright axis B to move relative to the true vertical axis C extending through the centerline D as depicted in FIG. 7.

The suspension system 32 may form the sole attachment between the extraction head 30 and the base assembly 22. However, as shown in FIGS. 4–6, the exemplary extraction tool 20 further comprises a pivot bracket 180 arranged between the coupling housing 142 of the extraction head 30 and the forward-most cross member 56*a* of the base frame 50. In particular, the exemplary pivot bracket 180 comprises an extension portion 182 welded or otherwise securely attached to the forward-most cross member 56*a*. The pivot bracket further comprises first and second bracket arms 184 and a bracket saddle 186. The bracket arms 184 space the bracket saddle 186 from the extension portion 182 such that the saddle portion extends below and supports the coupler housing 142 of the extraction head 30.

The coupler housing 142 and bracket saddle 186 are generally cylindrical such that, although the coupler housing 142 (and thus the extraction head 30) cannot move down relative to the bracket saddle 186 (and thus the base assembly 22), the base assembly 22 can rotate about the centerline D relative to the base assembly 22. Thus, although the pivot bracket 180 provides a third point of vertical support (in addition to the bolt assemblies 174), the extraction head 30 may still rotate relative to the base assembly 22 to allow the steering action described above.

Figure 9:
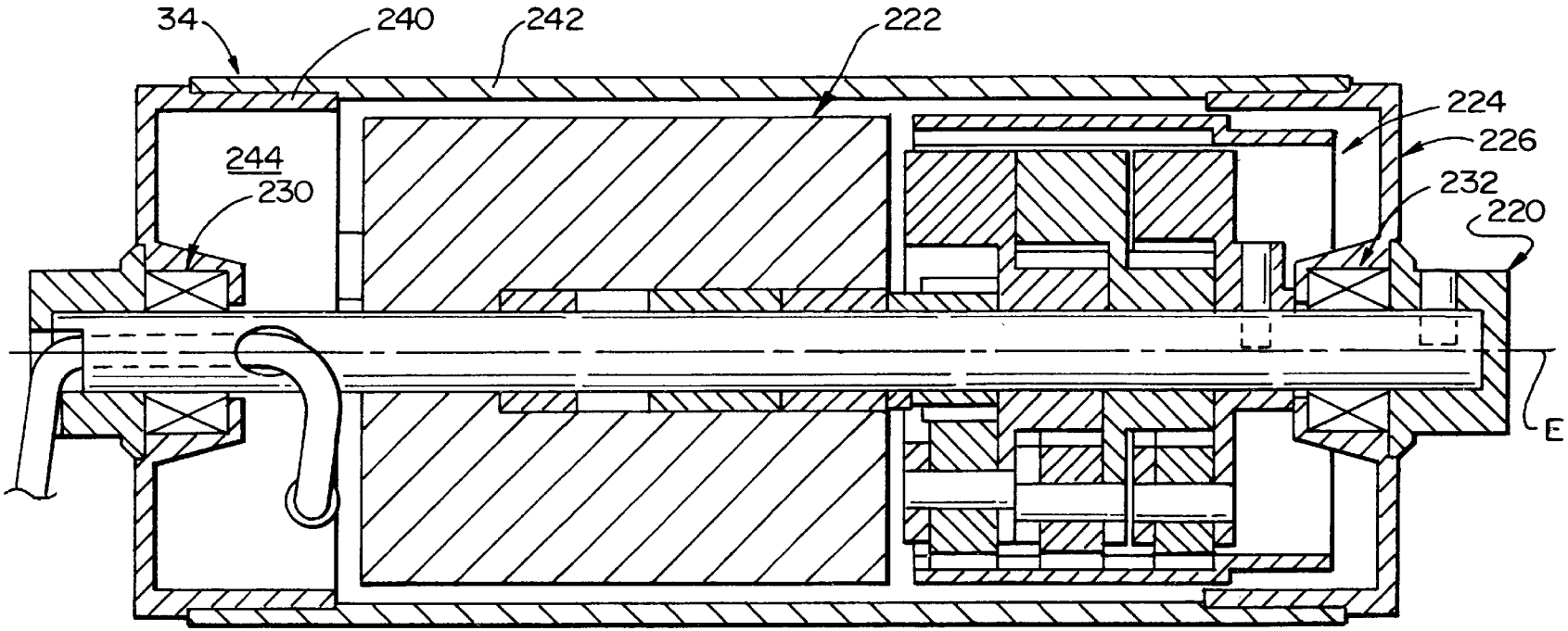
FIG. 9 is a section view of an self-propelled roller assembly used by the extraction tool of FIG. 1.

Referring now to the drive roller system 20, this system 20 will be described in further detail with reference to FIG. 9. The drive roller system 20 comprises the drive roller assembly 34 discussed above and a power source (not show). The switch mechanisms 84 and 86 will be arranged between the power source and the drive roller assembly 34 to form a control system that allows the user 42 to control the operation of the drive roller assembly 34 and thus the movement of the extraction tool 22. Again, the design and fabrication of the control system employed to operate the drive roller assembly 34 would be well within the ability of one of ordinary skill in the art and will not be described in further detail herein.

Drive roller assemblies such as the drive roller assembly 34 are well-known in the art of conveyor belts. Such drive roller assemblies are conventionally located at a fixed location on a frame and frictionally engage a conveyor belt supported by the frame to move the conveyor belt. The construction and operation of the drive roller assembly 34 will thus not be described herein beyond what is necessary for a complete understanding of the present invention.

The Applicants have recognized that drive roller assemblies designed for moving conveyor belts can be used to propel the extraction tool 20 of the present invention. In particular, the drive roller assembly 34 comprises a shaft assembly 220, a motor assembly 222, a transmission assembly 224, and a housing assembly 226. The motor assembly 222 and transmission assembly are entirely located within the housing assembly 226.

The shaft assembly 220 is fixed to the base frame 150. Bearing assemblies 230 and 232 support each end of the housing assembly 226 on the shaft assembly 220 such that the housing assembly 226 axially rotates about a drive axis E relative to the shaft assembly 220. The motor assembly 222 is fixed relative to the shaft assembly 220 and is operatively connected to the housing assembly 226 through the transmission assembly 224. The motor assembly 222 thus acts through the transmission assembly 224 to cause axial rotation of the housing assembly 226 about the drive axis E.

The drive roller assembly 28 is particularly suited for use as the motor for the extractor tool 20 for a number of reasons. First, the drive roller assembly 28 with its internal motor assembly 222 and transmission assembly 224 obviates the need for an external motor and transmission. The volume dedicated to propelling the extractor tool 20 is thus significantly reduced.

Second, the housing assembly 226 comprises a housing member 240 and housing cover 242. The housing member 240 defines a housing chamber 244. The bearing assemblies 230 and 232 are preferably sealed to seal the housing chamber 244; but even if they are not sealed, the openings through which the shaft assembly 220 extend are spaced from the wet floor surface 40, which will inhibit entry of contaminants to the housing chamber 244. The housing member 240 thus protects the motor assembly 222 and transmission assembly 224 from contaminants such as dust, dirt, moisture, and the like.

Third, the drive roller assembly 34 is relatively expensive, has a very high life cycle, and is designed to bear loads of the type experienced by the extractor tool 20.

Fourth, the housing cover 242 is designed for frictional engagement but also to reduce wear on the surface engaged. The cover thus can propel the tool 20 but does not unduly wear the floor surface 40.

Referring now for a moment back to FIG. 3, it can be seen that the exemplary extractor tool 20 further comprises first and second guide wheel assemblies 250 and 252. The guide wheel assemblies 250 and 252 are mounted to the upper wall 132 of the extractor head 30 such that their axes of rotation are vertically aligned and roller surfaces 254 and 256 of these assemblies 250 and 252 extend past the left and right side walls 138 and 140. Thus, when the extractor tool 20 is moving next to a vertical wall, the roller surfaces 254 and 256 engage and rotate along the surface of the wall to lessen the likelihood that the tool 20 will damage the wall.

In addition, FIGS. 1, 2, and 3 illustrate bumper pads 260 and 262 mounted on the ends of the frame member 54. These bumper pads 260 and 262 thus will engage most items, such as vertical walls, in the path of the extractor tool 20. The pads 260 and 262 are made of a resilient material that is less likely to damage the object in the path of the tool 20.

The extractor tool 20 is used in the following manner. Initially, the tool 20 is arranged on the floor surface 40 at a desired location. The tool 20 is then connected to the vacuum extraction machine 46. The extraction machine 46 is then operated to draw air through the extraction opening 122. The user 42 then stands on the support surface 66 with the user's feet on the foot locations 154 and 156 straddling the upper coupler 152 and the portion of the hose 44 adjacent to the coupler 152.

The user 42 then operates the direction switch mechanism 86 to select the desired direction: forward or reverse. The user 42 then grips the operation switch mechanism 84 to allow electrical energy to reach the motor assembly 222. The motor assembly 222 then causes the housing assembly 226 to rotate, through the transmission assembly 224, relative to the shaft assembly 220. Because the housing cover 242 frictionally engages the floor surface 40, the housing assembly 226 will begin to roll along this surface 40. The movement of the housing assembly 226 is transferred to the shaft assembly 220 through the bearing assemblies 230 and 232 such that the shaft assembly 220 also moves along the floor surface 40. And because the shaft assembly 220 is rigidly connected to the base frame 150, the entire base assembly 22 moves along the floor surface 40.

The extraction head 30 supports at least part of the weight of the user 42 and the tool 20; the extraction head 30 thus is held firmly against the floor surface 40 such that air entering the extraction opening 122 first passes through the floor covering defining the floor surface 40. Most, if not all, of the invasive liquid in the floor covering will be entrained in the flow of air entering the extraction opening 122.

The user 42 will adjust his or her position on the support surface 66 and apply lateral forces to the handle assembly 24 based on the specifics of the situation. For example, if the extractor tool 20 begins to drift to one side or the other, the user 42 can lean and apply lateral forces to the handle assembly 24 in the opposite direction to turn the tool 20 and compensate for this drift.

If the extractor tool 20 is going too fast, the user 42 can shift weight towards the extraction head 30, increasing friction on the extraction head 30 and decreasing friction on the drive roller assembly 34, which will tend to slow the tool 20. If the drive roller assembly 34 is having trouble establishing purchase with the floor surface 40, the operator can shift weight towards the drive roller assembly 34, thereby increasing friction between the drive roller assembly 34 and the floor surface 40. The speed of the tool 20 can also be adjusted depending upon the amount of invasive liquid remaining in the floor covering: slowing down will give the vacuum extraction machine 46 more time to remove a higher volume of invasive liquid.

From the foregoing, it should be clear that the present invention may be embodied in forms other than those described above.

For example, wheel assemblies similar to the wheel assemblies 250 and 254 may be mounted to the left and right side walls 138 and 140 of the extraction head 30 with their axes of rotation horizontally aligned and the roller surfaces slightly below the bottom edge of the extraction head 30. Such wheel assemblies would reduce friction on harder floor coverings such as hardwood but, with proper adjustment, would allow sufficient air flow to entrain invasive liquids on or in the floor covering.

As another example, a spray head may be provide adjacent to one or both of the front and back walls 134 and 136 of the extraction head 30. The spray head would allow the extraction tool to function as a cleaning system for floor coverings similar to a conventional carpet cleaner.

The above-described systems are therefore to be considered in all respects illustrative and not restrictive. The scope of the present invention should be determined by the following claims and not the foregoing detailed description.

What is claimed is:

1. A method of extracting fluid from a floor surface comprising the steps of:

a) providing an extraction tool having a frame assembly defining a support surface;

b) mounting an extraction head to the frame assembly, wherein the extraction head includes an extraction opening that engages with the floor surface;

c) mounting a drive roller assembly to the frame assembly, wherein the drive roller assembly engages the floor surface;

d) standing on the support surface between the extraction head and the drive roller assembly such that the weight of the user on the support surface is transferred to the extraction head or the drive roller assembly;

e) operating the drive roller assembly to propel the extraction tool along the floor surface;

f) extracting fluid from the floor surface through the extraction opening; and g) controlling the speed of the extraction tool across the floor surface by shifting the user's weight on the support surface such that movement of the user's weight towards the extraction head increases friction between the floor surface and the extraction head resulting in a decrease in speed of the extraction tool and movement of the user's weight towards the drive roller assembly results in an increase in speed of the extraction tool across the floor surface.

2. A method as recited in claim 1, in which the step of mounting the extraction head to the frame assembly further comprises the step of arranging a suspension system between the extraction head and the frame assembly.

3. A method as recited in claim 1, in which the step of mounting the extraction head to the frame assembly further comprises the step of pivotably mounting the extraction head to the frame assembly.

4. A method as recited in claim 1, further comprising the step of connecting a handle assembly to the frame assembly.

5. A method as recited in claim 1, wherein the step of mounting the drive roller assembly to the frame assembly further comprises the step of providing a motor assembly for driving the drive roller assembly within a housing assembly of the drive roller assembly.

6. A method as recited in claim 2, in which the step of arranging the suspension system between the extraction head and the frame assembly comprises the step of arranging first and second suspension assemblies between the extraction head and the frame assembly.

7. A method as recited in claim 6, in which the step of mounting the extraction head to the frame assembly further comprises the step of pivotably mounting the extraction head to the frame assembly.

8. A method as recited in claim 4, in which the step of connecting a handle assembly to the frame assembly comprises the step of rotatably attaching the handle assembly to the frame assembly such that the handle assembly can move between use and storage/transportation positions.

* * * * *